United States Patent [19]

Kashio

[11] 3,988,886

[45] Nov. 2, 1976

[54] TIME SETTING DEVICE FOR AN ELECTRONIC WATCH

[75] Inventor: Toshio Kashio, Tokyo, Japan

[73] Assignee: Casio Computer Co., Ltd., Tokyo, Japan

[22] Filed: Aug. 9, 1974

[21] Appl. No.: 496,196

[30] Foreign Application Priority Data

Aug. 14, 1973 Japan ..... 48-90502
Oct. 9, 1973 Japan ..... 48-113418

[52] U.S. Cl. ..... 58/23 R; 58/85.5
[51] Int. Cl.[2] ..... G04C 3/00
[58] Field of Search ..... 58/23 R, 85.5, 50 R, 58/34, 33

[56] References Cited

UNITED STATES PATENTS

| | | | |
|---|---|---|---|
| 3,788,058 | 1/1974 | Idei et al. | 58/23 R |
| 3,798,428 | 3/1974 | Izawa | 58/23 R X |
| 3,810,356 | 5/1974 | Fujita | 58/23 R |
| 3,852,950 | 12/1974 | Yoda et al. | 58/85.5 X |
| 3,852,952 | 12/1974 | Vittoz et al. | 58/23 R |

*Primary Examiner*—Ulysses Weldon
*Attorney, Agent, or Firm*—Flynn & Frishauf

[57] ABSTRACT

An electronic watch having a time-counting circuit comprising a plurality of cascade-connected counter stages where the counts are continuously carried in each predetermined lapse of time under control of output clock pulses from a clock pulse oscillator generating standard high frequency clock pulses with high accuracy, the counter stages being coupled with a time display device indicating momentarily changing time. The watch is provided with a time-setting device comprising an auxiliary counter circuit for designating independently the respective counter stages constituting the time-counting circuit, a normally open switch closed only when a time-setting operation is required and sequentially designating through the auxiliary counter circuit the respective counter stages from the highest stage to the lowest stage whose count is desired to be correct, and a counter for continuously and automatically adding one time-correction pulse after another having a predetermined frequency to one of the counter stages which is designated by the auxiliary counter circuit upon the actuation of the switch until the designated counter stage is stored with a desired number of counts, thereby attaining a time-setting operation as easily and speedily as possible.

5 Claims, 28 Drawing Figures

FIG. 5
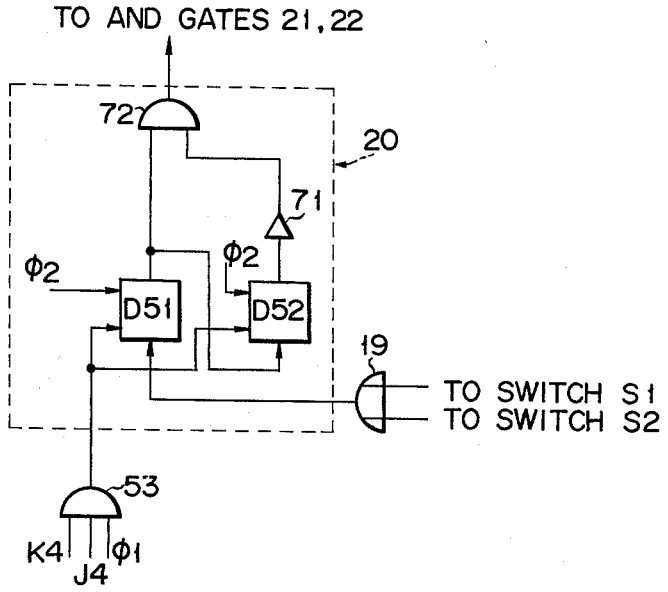
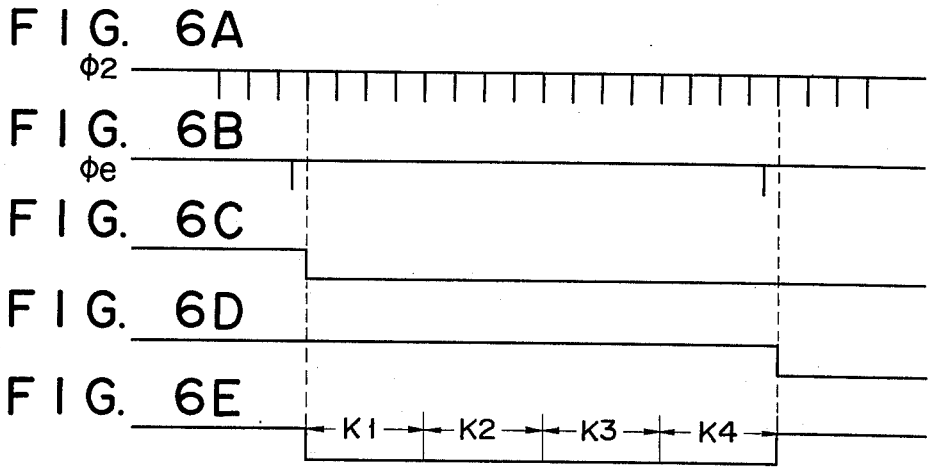

TIME SETTING DEVICE FOR AN ELECTRONIC WATCH

BACKGROUND OF THE INVENTION

This invention relates to a time-setting device for an electronic watch.

The term "time" used herein is intended to represent not only the divisions of the day such as seconds, minutes and hours but also days changing monthly and weekly and the corresponding dates.

An electronic watch is generally designed to carry out the counting operation for tracing momentarily changing time by continuously supplying a time-counting circuit coupled to a time display device and comprising as many cascaded counter stages of the later described construction as the required time display units on the display device with time counting pulses which have a frequency defined by the smallest time interval being displayed on the display device and which are obtained by frequency-dividing clock pulses having a predetermined very high accurate frequency, e.g. 32,768 Hz or 16,384 Hz, generated by a clock pulse oscillator such as a quartz oscillator, and to display the momentarily changing time on the display device. For example, the time-counting circuit comprises a second-counting stage for counting time-counting pulses at the rate of one pulse at the smallest time interval for example, per second and generating carry signals every sixty seconds or one minute, a minute-counting stage for counting the number of carry signals from the second-counting stage and producing carry signals every sixty minutes, and a hour-counting stage for counting the number of carry signals from the minute-counting stage.

A typical time-setting means for such an electronic watch may be considered as the type which continuously supplies a time-counting circuit of the above-mentioned construction with time-correcting pulses of considerably higher frequency than the time-counting pulses in place of ordinary time-counting pulses for tracing momentarily changing time. However, such a time-setting method is effective only for the purpose of setting time up to the order of seconds or minutes, but unavailable up to a higher order such as hours, days or dates, so that a very large number of time-correcting pulses and a long period are required for the time-setting operation.

With an electronic watch, it should be noted that minute correction of time up to the order of seconds or minutes is seldom required, since a clock pulse oscillator generally generates clock pulses having a predetermined very high accurate frequency.

In most cases, however, there is required a larger correction of time up to the order of hours, days or dates.

Therefore, the object of this invention is to provide a time-setting device for an electronic watch capable of correcting time indications on the watch as speedily as possible by a relatively simple operation regardless of the length of time required for correction.

SUMMARY OF THE INVENTION

A time-setting device according to a preferred embodiment of this invention is characterized by comprising a switch means operated only when time correction is required; an auxiliary counter circuit for sequently and independently designating a plurality of cascade-connected counter stages jointly constituting a time-counting circuit coupled with a time display device indicating momentarily changing time where the counts are to be corrected at each operation of the switch means; and counting means for continuously adding counts to that of the counter stages which is designated by the auxiliary counter circuit until the designated counter stage is stored with a desired number of counts. A time-setting device thus constructed has an advantage of correcting time as speedily as possible by a very simple operation regardless of the length of time required for correction.

A time-setting device according to another embodiment of this invention is characterized in that said time-counting circuit comprises a first time-counting circuit for counting the number of time counting pulses required to trace a lapse of the divisions of the day such as seconds, minutes and hours and a second time-counting circuit for counting the number of time counting pulses required to trace a lapse of days, weeks, months and dates; and that there is further provided with switch means for designating that of the first and second time counting circuits where the counts are to be changed by the counting means upon operation of the first-mentioned switch means.

BRIEF DESCRIPTION OF THE DRAWINGS

FIG. 6 is a practical arrangement of a synchronization control circuit shown in FIG. 1;

FIGS. 6A to 6E show waveforms useful for understanding the operation of the various circuit portions of FIG. 5;

PREFERRED EMBODIMENTS OF THE INVENTION

The preferred embodiments of a time-setting device for an electronic watch in accordance with this invention will now be described with reference to the accompanying drawings.

Figure 1:
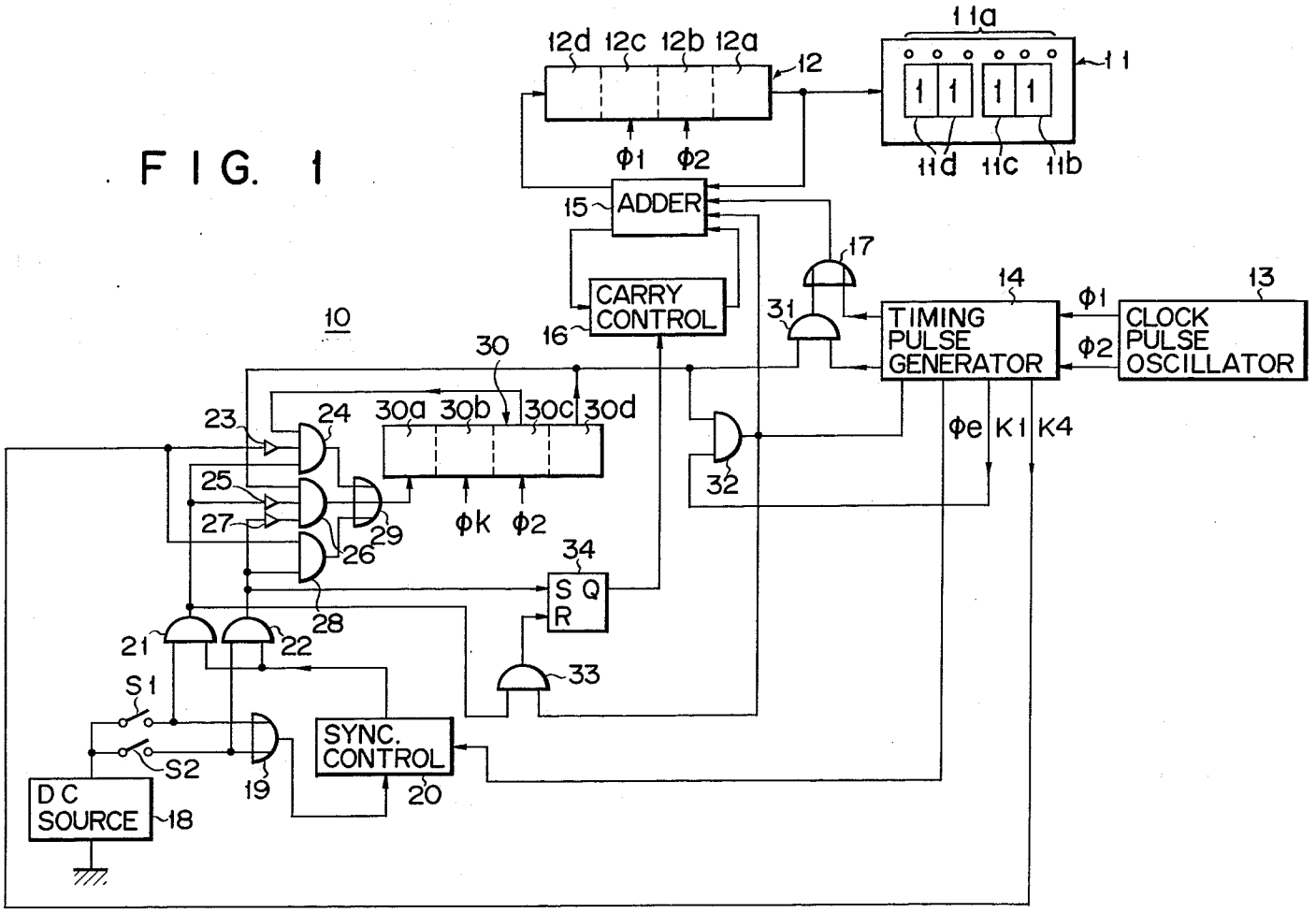
FIG. 1 shows a schematic block circuit diagram of a time-setting device according to one embodiment of this invention for an electronic watch.

FIG. 1 shows a schematic block circuit diagram of a time-setting device for an electronic watch according to one embodiment of this invention.

In this embodiment, there is employed a time display device 11 in which, for example, six first display elements 11*a* for displaying a lapse of time from 0 to 59 seconds in units of ten seconds, a second display element 11*b* for displaying a lapse of time from 0 to 9 minutes in units of one minute, a third display element 11*c* for displaying a lapse of time from 0 to 59 minutes in units of ten minutes, and two fourth display elements 11*d* for displaying a lapse of time from 0 to 12 hours in units of one hour are provided as display elements to display a lapse of momentarily changing time, said first display elements 11*a* each comprising, for example, a single liquid crystal or light-emitting diode and said second to fourth display elements 11*b* to 11*d* each comprising conventional seven liquid crystal or light-emitting diode segments arranged in the form of a numeral "8".

Thus, there is provided a time-counting circuit 12 constituted by four cascaded counter stages 12*a* to 12*d* of the later described construction for controlling the first to fourth display elements 11*a* to 11*d* in the time display device 11. Counts stored in the counter stages 12*a* to 12*d* jointly constituting the time-counting circuit 12 are shifted continuously as later described at a high speed of 10N times per 10 seconds through an adder circuit 15 coupled to the hereinunder described timing pulse generator 14 and a carry control circuit 16 under control of output clock pulses from a clock pulse oscillator 13 such as a quartz oscillator which generates two phase clock pulses $\phi 1$ and $\phi 2$ (see FIGS. 3A and 3B) having a predetermined and very accurate frequency, e.g., 32,768 Hz or 16,384 Hz.

Figure 2:
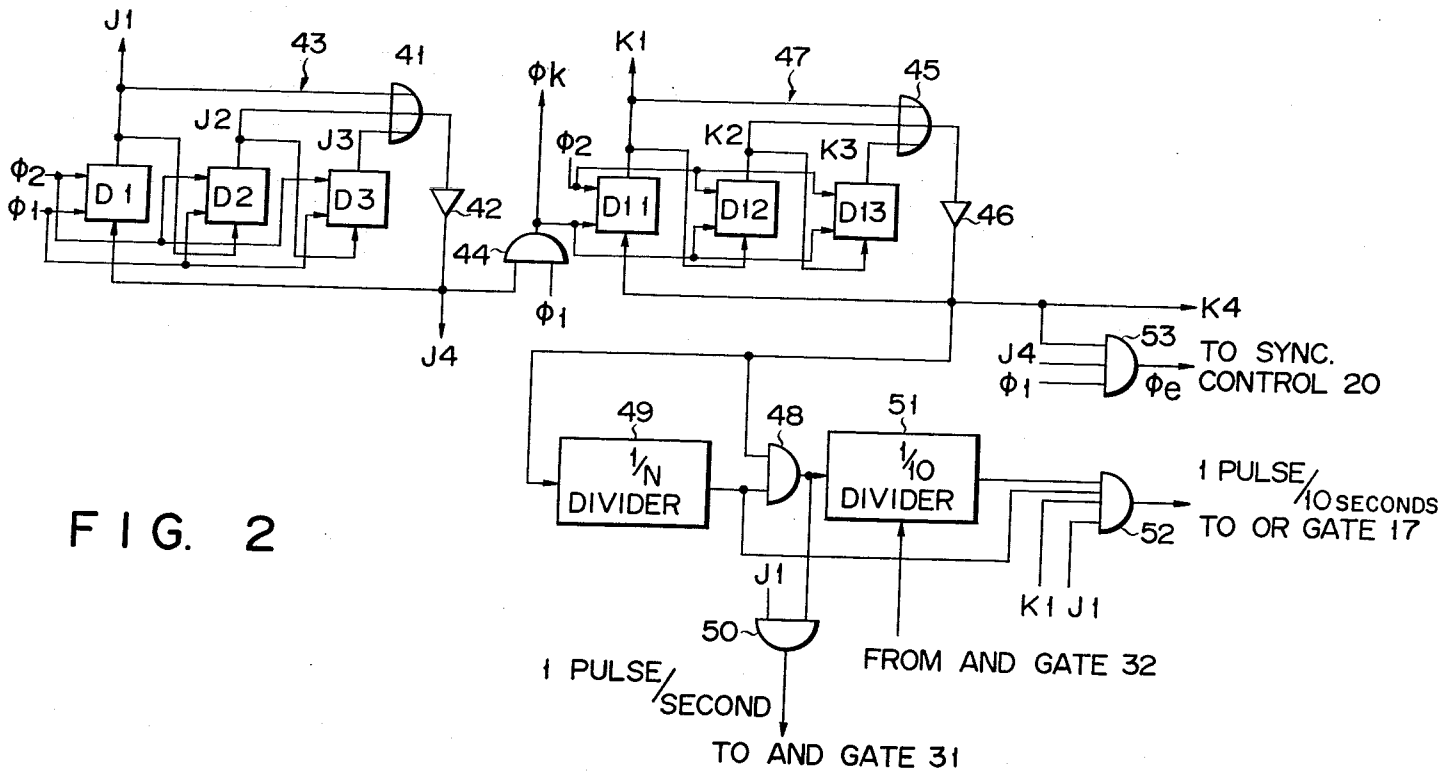
FIG. 2 is a practical circuit arrangement of a timing pulse generator shown in FIG. 1.
Figure 3:
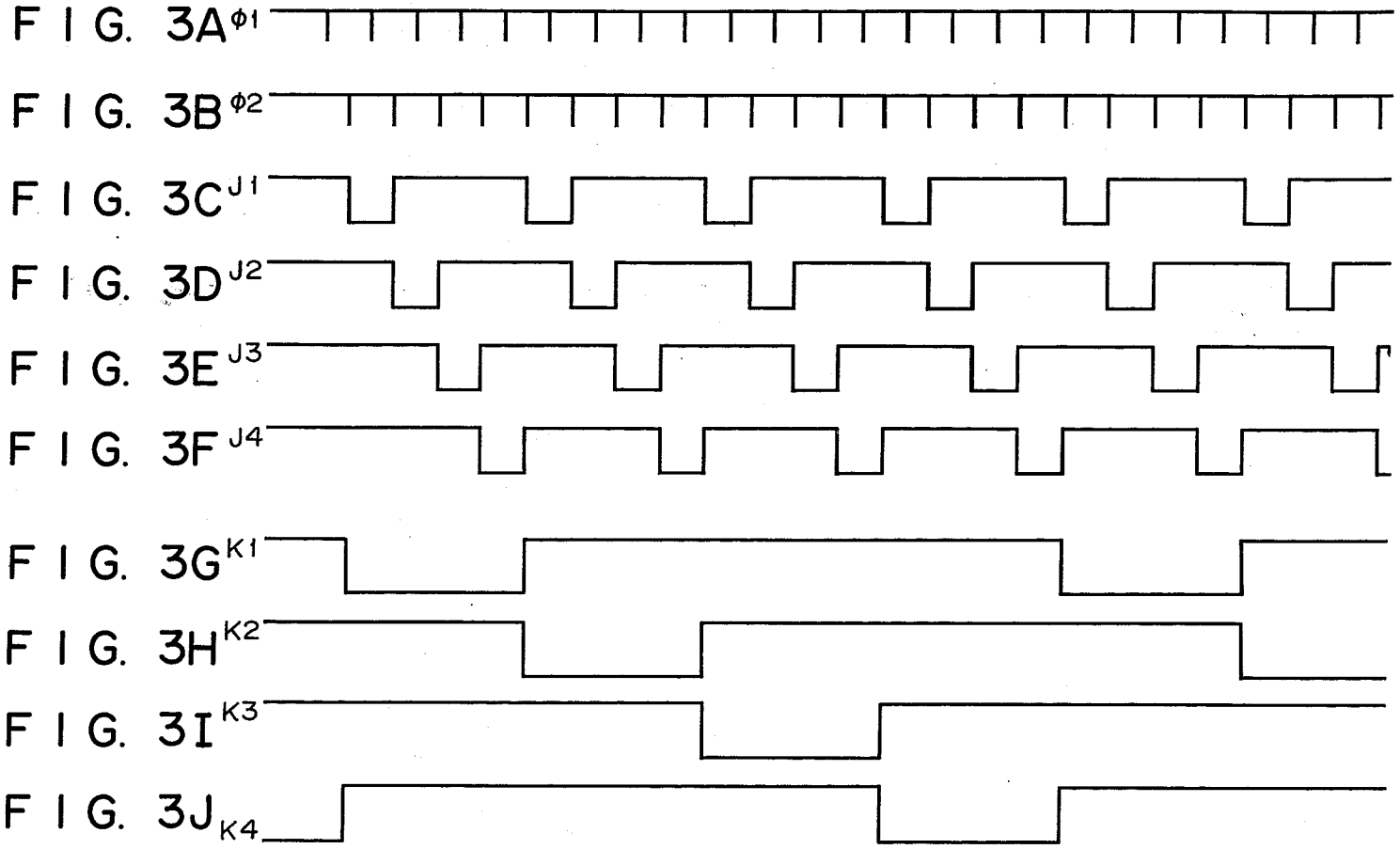
FIGS. 3A to 3J show waveforms illustrative of the operation of various circuit portions of FIG. 1.

The timing pulse generator 14 is designed, as shown in FIG. 2, to generate various timing pulses required for the watch under control of the two phase clock pulses $\phi 1$ and $\phi 2$ produced by the clock pulse oscillator 13. Thus, the timing pulse generator 14 comprises a first frequency divider 43 including three cascaded-delayed flip-flop circuits D1, D2 and D3 whose write-in operation is controlled by the first phase clock pulses $\phi 1$ as shown in FIG. 3A and whose read-out operation is controlled by the second phase clock pulses $\phi 2$ as shown in FIG. 3B, an OR gate 41 having input terminals supplied with respective outputs J1 to J3 of the flip-flop circuits D1 to D3, and an inverter 42 connected between the output terminal of the OR gate 41 and the input terminal of the first flip-flop circuit D1; an AND gate 44 having an input terminal supplied with an output J4 of the inverter 42 or the first frequency divider 43 and another input terminal supplied with the first phase clock pulses $\phi 1$; and a second frequency divider 47 having substantially the same construction as the first frequency divider 43 and including three cascaded-delayed flip-flop circuit D11 to D13 whose write-in operation and read-out operation are controlled by an output $\phi k$ of the AND gate 44 and the second phase clock pulses $\phi 2$, an OR gate 45 having input terminals supplied with respective outputs K1 to K3 of the flip-flop circuits D11 to D13, and an inverter 46 connected between the output terminal of the OR gate 45 and the input terminal of the first flip-flop circuit D11. An output K4 of the second frequency divider 47 or the inverter 46 is applied to an input terminal of an AND gate 48 and also to another input terminal thereof via an 1/N frequency divider 49. The output terminal of the AND gate 48 is connected to one input terminal of an AND gate 50, the other input terminal of which is connected to the output terminal of the first flip-flop circuit D1 included in the first frequency divider 43, and also to an input terminal of an AND gate 52 via a 1/10 frequency divider 51. The AND gate 52 has further input terminals connected to the output terminals of the first flip-flop circuits D1 and D11 included in the first and second frequency dividers 43 and 47 and the output terminal of the 1/N frequency divider 49. Also, the output K4 of the second frequency divider 47 is applied to an input terminal of an AND gate 53. The AND gate 53 has further input terminals supplied with the output J4 of the first frequency divider 43 and the first phase clock pulses $\phi 1$. According to the timing pulse generator 14 thus constructed, the first to third flip-flop circuits D1 to D3 and the inverter 42 jointly constituting the first frequency divider 43 generate pulse signals, as shown in FIGS. 3C to 3F, each having a pulse width equal to the operation period of each of delayed flip-flop circuits D21 to D24 (see FIG. 4) respectively constituting the counter stages 12*a* to 12*d* of the time-counting circuit 12 shown in FIG. 1. Similarly, the first to third flip-flop circuits D11 to D13 and the inverter 46 jointly constituting the second frequency divider 47 project pulse signals, as shown in FIGS. 3G to 3J, each having a pulse width equal to the operation period of all the counter stages 12*a* to 12*d* of the time-counting circuit 12.

Assuming that the aforesaid N has a value of 2048 where the clock pulses $\phi 1$ and $\phi 2$ generated by the clock pulse oscillator 13 have a frequency of 32,768 Hz and the N has a value of 1024 where the clock pulses $\phi 1$ and $\phi 2$ have a frequency of 16,384 Hz, then the AND gate 50 produces time-correcting pulses as described later at the rate of one pulse per second in synchronism with the output J1 of the first flip-flop circuit D1, and the AND gate 52 generates time-counting pulses as later described at the rate of one pulse per 10 seconds each time the counts in the counter stages 12*a* to 12*d* of the time-counting circuit 12 are shifted 10N times through the adder circuit 15.

Reverting to FIG. 1, the time-counting pulses generated at the rate of one pulse per 10 seconds and obtained through the AND gate 52 in synchronism with the respective outputs J1 and K1 of the first flip-flop circuits D1 to D11 of the various timing pulses generated by the timing pulse generator 14 are applied through an OR gate 17 to the adder circuit 15.

Figure 4:
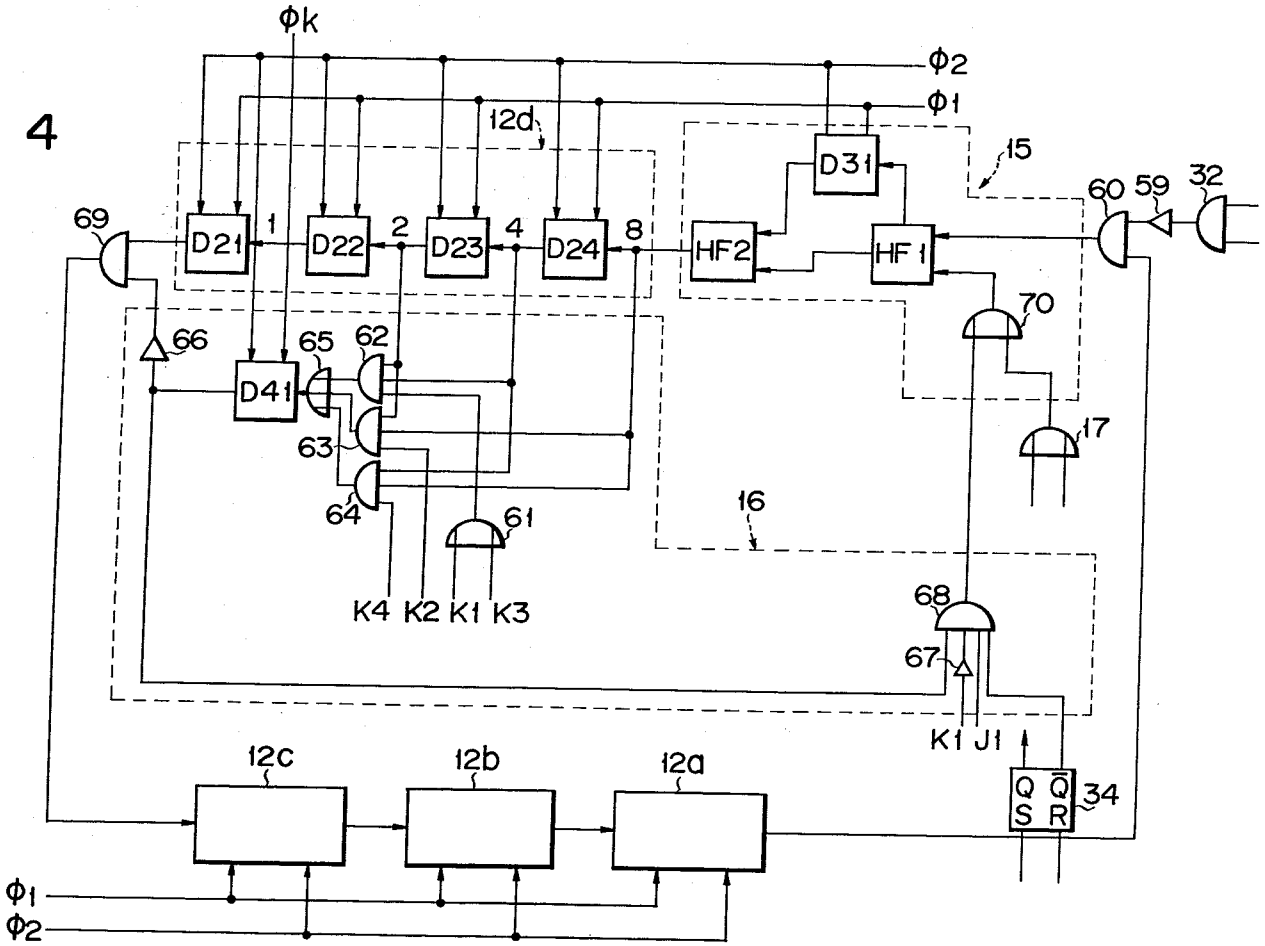
FIG. 4 is a practical arrangement of a time-counting circuit, an adder circuit and a carry control circuit shown in FIG. 1.

FIG. 4 shows a practical arrangement of the time counting circuit 12, adder circuit 15 and carry control circuit 16 shown in FIG. 1.

The time-counting circuit 12 comprises four cascaded counter stages 12*a* to 12*d* provided for the corresponding display elements 11*a* to 11*d* in the time display device 11.

The counter stages 12*a* to 12*d* are each constituted by four cascaded-delayed flip-flop circuits D21, D22, D23 and D24 (in FIG. 4, only the fourth or last counter stage 12*d* corresponding to the display elements 11*d* for displaying a lapse of time from 0 to 12 hours in units of one hour is shown in detail) which are designed to enable to carry out the counting operation corresponding to all the digits being displayed by the respective display elements 11*a* to 11*d* in the time display device 11 and whose write-in and read-out operations are controlled by the two phase clock pulses $\phi 1$ and $\phi 2$ from the clock pulse oscillator 13. A count output from the first counter stage 12*a* of the time-counting circuit 12 corresponding to the first display elements 11*a* of the time display device 11 for displaying a lapse of time from 0 to 59 seconds in units of ten seconds is applied to one input terminal of an AND gate 60, the other input terminal of which is connected via an inverter 59 to the output terminal of the AND gate 32 shown in FIG. 1.

The AND gate 60 has an output terminal connected to one input terminal of a front half adder HF1 included in the adder circuit 15 constructed of two half adder HF1 and HF2 series-connected via a delayed flip-flop circuit D31 whose write-in and read-out operations are controlled by the first and second phase clock pulses $\phi 1$ and $\phi 2$. The output terminal of the rear half adder HF2 in the adder circuit 15 is connected to the input terminal of the fourth or last flip-flop circuit D24 included in the last counter stage 12*d* of the time-counting circuit 12.

The respective inputs of the first to fourth flip-flop circuits D21 to D24 included in the fourth counter stage 12*d* of the time-counting circuit 12 have logical weights 1, 2, 4 and 8. Thus, the carry control circuit 16 comprises an AND gate 62 having three input terminals connected to the input terminals of the second and third flip-flop circuits D22 and D23 in the fourth counter stage 12*d* and to the output terminal of an OR gate 61 which has input terminals supplied with the outputs K1 and K3 of the first and third flip-flop circuit D11 and D13 included in the second frequency divider 47 shown in FIG. 2; an AND gate 63 having two input terminals connected to the input terminals of the second and fourth flip-flop circuits D22 and D24 in the fourth counter stage 12*d* and another input terminal supplied with the output K2 of the second flip-flop circuit D12 included in the second frequency divider 47 shown in FIG. 2; an AND gate 64 having two input terminals connected to the input terminals of the third and fourth flip-flop circuits D23 and D24 in the fourth counter stage 12*d* and another input terminal supplied with the output K4 of the inverter 46 included in the second frequency divider 47; an OR gate 65 having input terminals connected to the output terminals of the AND gates 62 to 64; a delayed flip-flop circuit D41 writing therein an output signal from the OR gate 65 under control of the output $\phi k$ of the AND gate 44 shown in FIG. 2 and reading out therefrom the stored signal under control of the second phase clock pulses $\phi 2$; an inverter 66 having an input terminal connected to the output terminal of the flip-flop circuit D41; and an AND gate 68 having four input terminals supplied with the output of the flip-flop circuit D41, the Q output of the R—S flip-flop circuit 34 shown in FIG. 1, the output J1 of the first flip-flop circuit D1 included in the first frequency divider 43 shown in FIG. 2, and the output K1 of the first flip-flop circuit D11 included in the second frequency divider 47 shown in FIG. 2 through an inverter 67. The inverter 66 has an output terminal connected to one input terminal of an AND gate 69, the other input terminal of which is connected to the output terminal of the first flip-flop circuit D21 included in the fourth counter stage 12*d* of the time-counting circuit 12.

The AND gate 69 has an output terminal connected to the input terminal of the third counter stage 12C in the time-counting circuit 12. The AND gate 68 has an output terminal connected to one input terminal of an OR gate 70 included in the adder circuit 15, the OR gate 70 having the other input terminal connected to the output terminal of the OR gate 17 shown in FIG. 1.

The output terminal of the OR gate 70 is connected to the other input terminal of the front half adder HF1 in the adder circuit 15.

The operation of the circuitry shown in FIG. 4 will now be described. It will be apparent to those skilled in the art that the data counted in the first to fourth counter stages 12*a* to 12*d* of the time-counting circuit are continuously shifted 10N times per 10 seconds through the adder circuit 15, under the condition where the first to fourth counter stages 12*a* to 12*d* are always operated in synchronism with the corresponding first to third flip-flop circuits D11 to D13 and the inverter 46 included in the second frequency divider 47 of FIG. 2 and the respective four flip-flop circuits in the first to fourth counter stages 12*a* to 12*d* are always operated in synchronism with the corresponding first to third flip-flop circuits D1 to D3 and the inverter 42 included in the first frequency divider 43 of FIG. 2.

Accordingly, the count output of the first counter stage 12*a* in the time-counting circuit 12 is supplied to the adder circuit 15 in synchronism with the time-counting pulses obtained at the rate of one pulse per 10 seconds through the AND gate 52 in the timing pulse generator 14 and the OR gates 17 and 70, each time the data counted in the first to fourth counter stages 12*a* to 12*d* of the time-counting circuit 12 are shifted 10N times through the adder circuit 15. Consequently, the count of the first counter stage 12*a* in the time-counting circuit 12 is increased by one per 10 seconds. Thus, a first carry signal is generated through the AND gate 62, the OR gate 65, the flip-flop circuit D41 having its delay time equal to the operation period of each of the first to fourth counter stages 12*a* to 12*d* jointly constituting the time-counting circuit 12, as well as through the AND gate 68, all included in the carry control circuit 16, and the OR gate 70 in the adder circuit 15, each time the count of the first counter stage 12*a* is increased continuously to reach "6".

The resultant first carry signal is supplied to the adder circuit 15 in synchronism with the output of the second counter stage 12*b* in the time-counting circuit 12 and acts to add "one" to the counts of the second counter stage 12*b*.

At the same time, the counts of the first counter stage 12*a* are cleared to become zero by the action of inverter 66 in the carry control circuit 16, whereby the first counter stage 12*a* constitutes scale of 6 counter. A second carry signal similar to the first one is generated through the AND gate 63, the OR gate 65, the flip-flop circuit D41 as well as through the AND gate 68, all included in the carry control circuit 16 and the OR gate 70 in the adder circuit 15, each time the count of the second counter stage 12*b* is increased continuously to reach "10" through the repeated carrying action by the first counter stage 12*a*. The resultant second carry signal is supplied to the adder circuit 15 in synchronism with the output of the third counter stage 12*c* in the time-counting circuit 12 and acts to add "one" to the count of the third counter stage 12*c*. At this time, the count of the second counter stage 12*b* is cleared to reduce zero by the action of the inverter 66, the second counter stage 12*b* constituting scale of 10 counter. A third carry signal similar to the first and second ones is generated through the AND gate 62, OR gate 65, flip-flop circuit D41 and AND gate 68 included in the carry control circut 16 and the OR gate 70 in the adder circuit 15, each time the count of the third counter stage 12*c* is increased continuously to reach "6" through the repeated carrying action by the second counter stage 12*b*. The resultant third carry signal is supplied to the adder circuit 15 in synchronism with the output of the fourth counter stage 12*d* in the time-counting circuit 12 and acts to add "one" to the count of the fourth counter stage 12*d*. At this time, the count of the third counter stage 12*c* is cleared to reduce zero by the action of the inverter 66, the third counter stage 12*c* being constructed as scale of 6 counter the same as the first counter stage 12*a*.

The count of the fourth counter stage 12*d* is cleared to reduce zero through the AND gate 64, OR gate 65, flip-flop circuit D41 and inverter 66 included in the carry control circuit 16, each time the count of the fourth counter stage 12*d* is increased continuously to reach "12" through the repeated carrying operation by the third counter stage 12*c*, thus the fourth counter stage 12*d* constituting scale of 12 counter.

At this time, a carry signal generated whenever the fourth counter stage 12*d* counts "12" is not delivered from the AND gate 68 by the action of the inverter 67 so as to prevent the count of the first counter stage 12*a* from being increased by one. In consequence, the first to fourth counter stages 12*a* to 12*d* repeat the above-mentioned operation without any obstruction.

With the electronic watch constructed as mentioned above, it will be apparent that momentarily changing time can be correctly displayed on the time display device 11 by customarily controlling time indication on the first to fourth display elements 11*a* to 11*d* thereof by the respective outputs of the corresponding first to fourth counter stages 12*a* to 12*d* of the time-counting circuit 12.

According to the present invention, a time-setting device of the hereinunder described construction is provided in the electronic watch of the above-mentioned construction in order to carry out as speedily as possible by a relatively simple operation the time-setting operation required in the case of, for example, overseas trips or the exchange of battery constituting the DC power source of the electronic watch.

First and second normally open switches S1 and S2 is provided for correcting time indication on the display device 11. The switches S1 and S2 have their movable contacts connected to one pole of a DC power source 18 comprising for example, mercuric oxide cell of 1.5 volts consitituting the power source of the electronic watch, the other pole of the DC power source 18 being connected to ground.

The fixed contacts of the switches S1 and S2 are connected to input terminals of an OR gate 19. The output of the OR gate 19 is supplied to a synchronization control circuit 20 of the latter described construction together with the output $\phi e$ of the AND gate 53 in the timing pulse generator 14. The output terminal of the synchronization control circuit 20 is connected to one input terminal of an AND gate 21, the other input terminal of which is connected to the fixed contact of the first normally open switch S1 and also to one input terminal of an AND gate 22, the other input terminal of which is connected to the fixed contact of the second normally open switch S2. The AND gate 21 has an output terminal connected to an input terminala of an AND gate 24 having another input terminal supplied with the output K4 of the inverter 46 in the second frequency divider 47 through an inverter 23 and also to an input terminal of an AND gate 26 via an inverter 25.

The AND gate 22 has an output terminal connected to another input terminal of the AND gate 26 via an inverter 27 and also to one input terminal of an AND gate 28, the other input terminal of which is supplied with the output K4 of the inverter 46. The respective output terminals of the AND gates 24, 26 and 28 are collectively connected via an OR gate 29 to the input terminal of an auxiliary counter circuit 30 constituted by four cascaded counter stages 30*a* to 30*d* the stored information in which is always shifted in synchronism with the count of the time-counting circuit 12 under control of the output $\phi k$ of the AND gate 44 shown in FIG. 2 and the second phase clock pulses $\phi 2$.

The output terminal of the third counter stage 30*c* in the auxiliary counter circuit 30 is connected to a further input terminal of the AND gate 24. The output terminal of the fourth or last counter stage 30*d* in the auxiliary counter circuit 30 is connected to a further input terminal of the AND gate 26 and also to one input terminal of an AND gate 31, the other input terminal of which is supplied with time-correcting pulses generated at the rate of one pulse per second from the AND gate 50 (see FIG. 2) in the timing pulse generator 14. The AND gate 31 has an output terminal connected to the other input terminal of the OR gate 17.

The output terminal of the last counter stage 30*d* in the auxiliary counter circuit 30 is also connected to one input terminal of an AND gate 32, the other input terminal of which is supplied with the output K1 of the first flip-flop circuit D11 in the second frequency divider 47 (see FIG. 2).

The output of the AND gate 32 is supplied to the adder circuit 15 as a clear signal for clearing, as later described, the count of the first counter stage 12*a* in the time-counting circuit 12 to reduce zero and also to the 1/10 frequency divider 51 included in the timing pulse generator 14 as a clear or reset signal for clearing the stored information in the divider 51. The output terminal of the AND gate 32 is further connected to one input terminal of an AND gate 33 having the other input terminal connected to the output terminal of the AND gate 21. The AND gate 33 has an output terminal connected to a reset terminal of a R–S flip-flop circuit 34 having a set terminal connected to the output terminal of the AND gate 22.

The Q of the R–S flip-flop circuit 34 is supplied to the carry control circuit 16 as a carry-stopping signal as later described.

FIG. 5 is a practical arrangement of the synchronization control circuit 20 shown in FIG. 1.

The synchronization control circuit 20 comprises two cascaded-delayed flip-flop circuits D51 and D52 for writing in a DC voltage signal obtained from the DC source 18 when either of the first and second time-correcting normally open switches S1 and S2 is closed, under control of the output $\phi e$ (see FIG. 6B) of the AND gate 53 in the timing pulse generator 14 shown in FIG. 2, and reading out the stored information therefrom under control of the second phase clock pulses $\phi 2$ as shown in FIG. 6A (see FIG. 6B); and an AND gate 72 having an input terminal connected to the output terminal of the front flip-flop circuit D51 and another input terminal connected via an inverter 71 to the output terminal of the rear flip-flop circuit D52.

According to the synchronization circuit 20, when either of the two normally open switches S1 and S2 is closed, the front flip-flop circuit D51 generates pulse signals as shown in FIG. 6C and the rear flip-flop circuit D52 produces through the inverter 71 pulse signals as shown in FIG. 6D. Consequently, the AND gate 72 delivers pulse signals, as shown in FIG. 6E, having a pulse width equal to the entire operation period of the first to fourth counter stages 12*a* to 12*d* jointly constituting the time-counting circuit 12, i.e., the time period required for the counts of the first to fourth counter stages 12*a* to 12*d* to be shifted through the adder circuit 15.

Figures 7A, 7B, 7C, 7D, 7E, 7F, 7G, 7H:
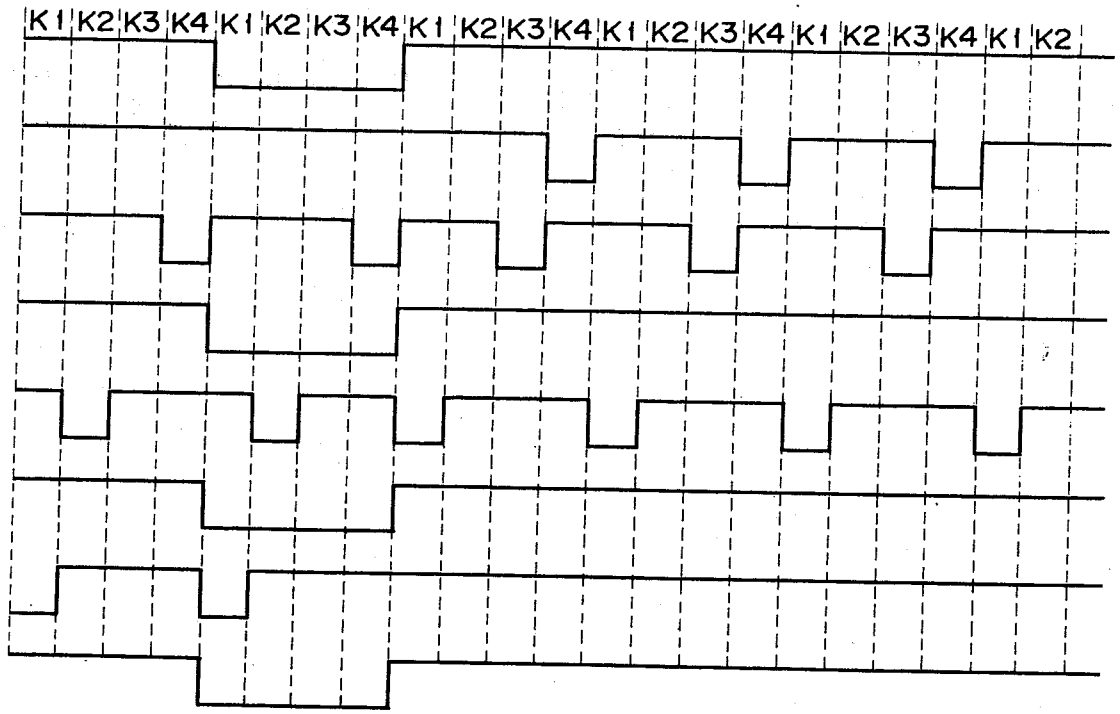
FIGS. 7A to 7H show waveforms useful for understanding the operation of a time-setting circuit portion of FIG. 1.

The operation of the time-setting device 10 arranged as described above will now be described by reference to FIGS. 7A to 7H. Where momentarily changing time is correctly indicated by the respective time display elements 11*a* to 11*d* of the time display device 11 under control of output signals from the first to fourth counter stages 12*a* to 12*d* included in the time-counting circuit 12, eliminating the necessity of carrying out any time setting, then the first and second normally open switches S1 and S2 are kept open. Under such condition, shifting takes place in the auxiliary counter circuit 30 through the AND gate 26 and OR gate 29 in synchronizm with the shifting occurring in the time-counting circuit 12 through the adder circuit 15. Since, at this time, no signal is stored in the first to fourth counter stages 30*a* to 30*d* of the auxiliary counter circuit 30, no time setting obviously takes place.

Where time-setting is required as in overseas trips or exchange of battery constituting a power supply for the watch, the second normally open switch S2 is first closed and immediately after opened again. At this time, the AND gate 22 gives forth through the synchronization circuit 20 a pulse signal (see FIG. 6E) having a time width corresponding to the length of time required for the counts stored in the first to fourth counter stages 12*a* to 12*d* of the time-counting circuit 12 to be shifted through the adder circuit 15. An output signal from the AND gate 22 thus obtained sets the R–S flip-flop circuit 34, which in turn delivers a carry-stopping signal to the carry control circuit 16. As the result, the normal time-counting operation of the time-counting circuit 12 is temporarily brought to rest, preventing the time display elements 11*a* to 11*d* of the time display device 11 from indicating momentarily changing time. At this time, an output pulse signal from the AND gate 22 is conducted to the AND gate 28, together with an output signal K4 from the inverter 46 included in the second frequency divider 47 of the timing pulse generator 14, causing an output signal K4 from the inverter 46 to be supplied to the auxiliary counter circuit 30 through the AND gate 28 and OR gate 29. The signal K4 is repeatedly shifted, as shown in FIG. 7B, through the first to fourth counter stages 30*a* to 30*d* of the auxiliary counter circuit 30, AND gate 26 and OR gate 29 so as to be drawn out from the fourth counter stage 30*d* of the auxiliary counter circuit 30 in synchronism with the count of the fourth counter stage 12*d* in the time-counting circuit 12, each time said count is supplied to the adder circuit 15. Thus the AND gate 50 in the timing pulse generator 14 produces time-correcting pulses at the rate of one pulse per second through the AND gate 31 and OR gate 17. As the result, the count of the fourth counter stage 12*d* in the time-counting circuit 12 is advanced at the rate of one per second, causing the digit indicated on the time display element 11*d* of the time display device 11 indicating a lapse of hours from 0 to 12 in units of hours to be increased by one per second. When the digit indicated on the time display element 11*d* has been corrected to a normal value, then the first normally open switch S1 is first closed and immediately thereafter opened again. Accordingly, the AND gate 21 produces a pulse signal of FIG. 7D having the same pulse width as that of FIG. 7A through the synchronization control circuit 20. An output pulse signal from the AND gate 21 thus obtained is conducted to the AND gate 24 and also to the AND gate 26 through the inverter 25. Where, therefore, the normally open switch S1 is closed, the first shifting passageway of the auxiliary counter circuit 30 is formed through the AND gate 24 instead of through the AND gate 26 so as to act as a shifting passageway effecting shifting in a shorter time by one bit than the length of time required for shifting in the time counting circuit 12. The second and subsequent shifting passageways are formed again through the AND gate 26 in place of through the AND gate 24 as normal shifting passageways carrying out shifting in the same length of time as shifting in the time-counting circuit 12. As the result, an output pulse is drawn out, as shown in FIG. 7C, from the fourth counter stage 30*d* in the auxiliary counter circuit 30 per shifting cycle in the time-counting circuit 12, each time the count of the third counter stage 12*c* in the time-counting circuit 12 is supplied to the adder circuit 15. Thus, the count of the third counter stage 12*c* in the time-counting circuit 12 is increased by one per second by the adder circuit 15, causing the digit indicated on the time display element 11*c* indicating a lapse of time from 0 to 59 minutes in units of 10 minutes to be increased by one per second. Where the digit indicated on the time display element 11*c* coincides with the correct time, the first normally open switch S1 is closed for the second time and immediately thereafter opened again.

The above-mentioned operation causes the AND gate 21 to give forth an output pulse of FIG. 7F having the same pulse width as those of FIGS. 7A and 7D through the synchronization control circuit 20. Thus, the fourth counter stage 30*d* in the auxiliary counter circuit 30 produces, as shown in FIG. 7E, an output pulse per shifting cycle in the time-counting circuit 12, each time the count of the second counter stage 12*b* in the time-counting circuit 12 is supplied to the adder circuit 15. As the result, the count stored in the second counter stage 12*b* is increased by one per second by the adder circuit 15, causing the digit appearing on the second time display element 11*b* in the time display device 11 indicating a lapse of time from 0 to 9 minutes in units of 1 minute to be increased by one per second. When the digit presented on the time display element 11*b* coincides with the correct time, then the first normally open switch S1 is closed for the third time and immediately after opened. The abovementioned operation causes the fourth counter stage 30*d* in the auxiliary counter circuit 30 to generate an output pulse per shifting cycle in the time-counting circuit 12, each time the count of the first counter stage 12*a* in the time-counting circuit 12 is delivered to the adder circuit 15. At this time the AND gate 32 generates an output signal, which clears the count of the first counter stage 12*a*. Thus, a digit 0 appears on the first time display element 11*a*, which, under the normal condition of the time display device 11, indicates a lapse of time from 0 to 59 seconds in units of 10 seconds by increasing the indicated digit by one each time, and data stored in the 1/10 frequency divider 51 in the timing pulse generator 14 is cleared. An output signal given forth at this time from the AND gate 33 resets the R–S flip-flop circuit 34, thereby locking the supply of carry-stopping signal from the flip-flop circuit 34 to the carry control circuit 16. Under this condition, the normally open switch S1 is for the fourth time or finally closed in exact timing with, for example, the announcement of the correct time and immediately after opened ready for the next time correction. As the result, an output pulse signal of FIG. 7H from the AND gate 21 having the same pulse width as those of FIGS. 7A and 7D rise simultaneously with an output signal of FIG. 7G from the fourth counter stage 30*d* in the auxiliary counter circuit 30. Since all the first to fourth counter stages 30*a* to 30*d* in the auxiliary counter circuit 30 are cleared, none of the AND gates 24, 26, and 28 generate any output signal, and in consequence no signal shifting takes place in the auxiliary counter circuit 30. As the result, the AND gate 31 ceases to give forth time-correcting pulse signals at the rate of one per second. Since the AND gate 32 neither produces an output signal, the 1/10 frequency divider 51 in the timing pulse generator 14 is released from the reset state to be ready for a normal operation. When the time-setting operation of the time-setting device 10 is fully completed, the timing pulse generator 14 is again brought to a normal operating condition. The AND gate 52 in the timing pulse generator 14 supplies the adder circuit 15 with time-counting pulses at the rate of one per 10 seconds through the OR gate 17. The time display elements 11*a* to 11*d* again correctly indicate momentarily changing time under control of output signals from the first to fourth counter stages 12*a* to 12*d* in the time-counting circuit 12.

Figure 8:
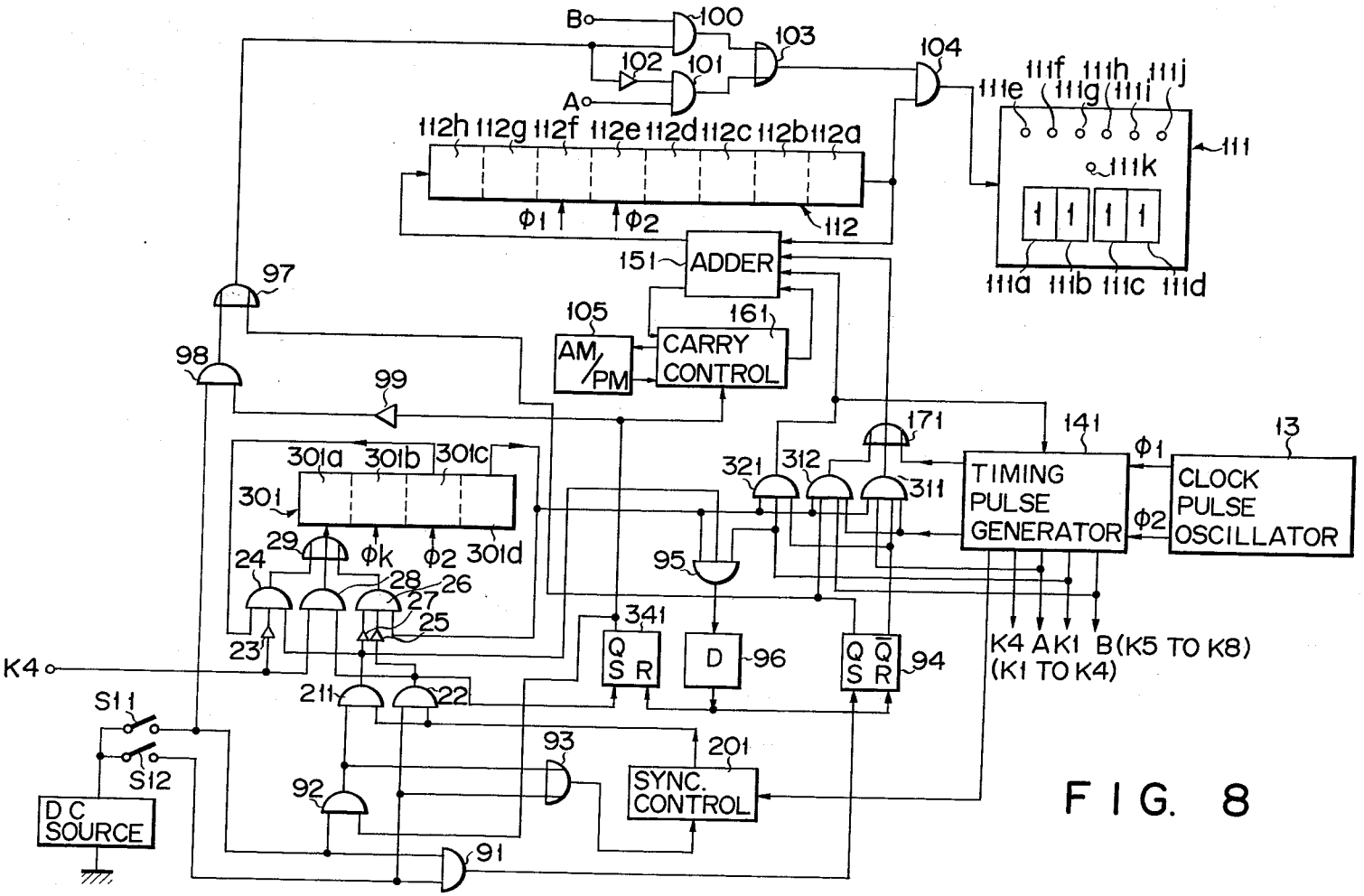
FIG. 8 shows a schematic block circuit diagram according to another embodiment of this invention.

FIG. 8 is a schematic block circuit diagram of a time-setting device according to another embodiment of this invention for an electronic watch. According to this embodiment, the first and second time display elements 111*a* and 111*b* included in a first assembly of four time display elements 111*a* to 111*d* corresponding to the time display elements 11*b* to 11*d* of FIG. 1 indicate a lapse of time from 0 to 12 hours in units of hours, or, if required, the sequential numbers of the months of the year in units of months by simple changeover operation. The third time display element 111*c* indicates momentarily changing time from 0 to 59 minutes in units of 10 minutes, or, where necessary, the days of the month in units of 10 days by similarly simple changeover operation. The fourth time display element 111*d* indicates a lapse of time from 0 to 9 minutes in units of minutes, or, in case of need, the days of the month from the first to the ninth days in units of days by the aforesaid changeover operation.

In addition to the aforesaid first assembly of four time display elements 111*a* to 111*d*, there is further provided a second assembly of six time display elements 111*e* to 111*j* formed corresponding to the time display elements 11*a* of FIG. 1 and of light-emitting diodes or liquid crystals, which indicate momentarily changing time from 0 to 59 seconds in units of 10 seconds, or if necessary, the days of the week excluding Sunday by changeover operation. A separately provided time display element 111*k* interchangeably indicates Sunday and AM/PM. In addition to the first to fourth counter stages 112*a* to 112*d* corresponding to the first to fourth counter stages 12*a* to 12*d* of FIG. 1, the embodiment of FIG. 8 includes a fifth 7-scale counter stage 112*e* for undertaking counting corresponding to the seven days of the week, a sixth 10-scale counter stage 112*f* for carrying out counting corresponding to 1 to 9 days in units of days, a seventh 3-scale counter stage 112*g* for effecting counting corresponding to 0 to 30 days in units of 10 days and an eighth 12-scale counter stage 112*h* for performing counting corresponding to the months of the year in units of months, the additional counter stages 112*e* to 112*h* being of the same bit arrangement as the first to fourth counter stages 112*a* to 112*d* and all the counter stages 112*a* to 112*h* being cascade connected. Further, in the embodiment of FIG. 8, the first and second frequency dividers 43 and 47 (see FIG. 2) in the timing pulse generator 14 of FIG. 1 are replaced by first and second frequency dividers each comprising a 7-stage delayed flip-flop circuit and inverter (not shown). Therefore, the embodiment of FIG. 8 should be so designed that a value of N is equal to half the value of N in the first embodiment. To this end, the timing pulse generator 141 generates a first indication changeover signal A having a time width (represented by K1 to K4 collectively) equal to the operating period of each of the first to fourth counter stages 112*a* to 112*d* in the time-countinng circuit 112 and a second indication changeover signal B having a time width (denoted by K5 to K8 collectively) equal to the operating period of each of the fifth to eighth counter stages 112*e* to 112*h*. Further, time-correcting pulses given forth by the timing pulse generator 141 at the rate of one per second as in the first embodiment are supplied to an input terminal of each of two AND gates 311 and 312 instead of the AND gate 31 of FIG. 1. The AND gates 311 and 312 each have another input terminal connected to the ouptut terminal of the fourth counter stage 301*d* included in an auxiliary counter circuit 301 having substantially the same arrangement as the auxiliary counter circuit 30 of FIG. 1. The output terminal of the fourth counter stage 301*d* is also connected to an input terminal of an AND gate 321 instead of the AND gate 32 of FIG. 1. The AND gate 311 has a further input terminal supplied with the first indication changeover signal A, and the AND gate 312 has a further input terminal supplied with the second indication changeover signal B. The AND gate 321 has another input terminal supplied with a signal K1 given forth by the timing pulse generator 141 in the same manner as by the timing pulse generator 14 of FIG. 1.

Further, the timing pulse generator 141 supplies a synchronization control circuit 201 of substantially the same arrangement as the synchronization control circuit 20 of FIG. 1 with a signal $(K4 + K8)\cdot\phi 1$ in place of the signal $(K4\cdot J4\cdot\phi 1\cdot)$ used in FIG. 1.

The OR gate 19 of FIG. 1 is replaced by an AND gate 91 having two input terminals connected to the fixed contacts of first and second time-correcting normally open switches S11 and S12 of the same arrangement as the time-correcting normally open switches S1 and S2 of FIG. 1; an AND gate 92 having an input terminal connected to the fixed contact of the first normally open switch S11 and another input terminal supplied with the Q output of a R–S flip-flop circuit 341 corresponding to the R–S flip-flop circuit 34 of FIG. 1; and an OR gate 93 having two input terminals connected to the fixed contact of the second normally open switch S12 and the output terminal of the AND gate 92 respectively, the output terminal of the AND gate 92 being further connected to one input terminal of an AND gate 211 corresponding to the AND gate 21 of FIG. 1.

The Q output of the R–S flip-flop circuit 341 is impressed as a carry-stopping signal on a carry control circuit 161 of substantially the same arrangement as the carry control circuit 16 of FIG. 1.

In this embodiment, there are further provided a R–S flip-flop circuit 94 having a set terminal connected to the output terminal of the AND gate 91; and an AND gate 94 having input terminals connected to the output terminals of the AND gate 211 and of the fourth counter stage 301*d* in the auxiliary counter circuit 301 and another input terminal supplied with a K1 signal from the timing pulse generator 141. The output terminal of the AND gate 95 is connected through a delay circuit 96 having its delay time equal to the operating period of each of the first to eighth counter stages 112*a* to 112*h* in the time-counting circuit 112 to the respective reset terminals of the R–S flip-flop circuits 341 and 94.

The Q output of the R–S flip-flop circuit 94 is supplied to another input terminal of each of the AND gates 311 and 321. The Q output of the R–S flip-flop circuit 94 is impressed on another input terminal of the AND gate 312 and one input terminal of an OR gate 97. Thus, output signals from the AND gates 311 and 312 are conducted to an OR gate 171 corresponding to the OR gate 17 of FIG. 1 together with time-counting pulses produced by the timing pulse generator 141 at the rate of one per 10 seconds as by the timing pulse generator 14 of FIG. 1. An output signal from the AND gate 321 is conducted as a clear signal to the timing pulse generator 141 as in the first embodiment and also to an adder circuit 151 of substantially the same arrangement as the adder circuit 15 of FIG. 1. The Q output of the R–S flip-flop circuit 341 is further supplied through an inverter 99 to one input terminal of an AND gate 98, the other input terminal of which is connected to the fixed contact of the first normally open switch S11. The AND gate 98 has an output terminal connected to the other input terminal of the OR gate 97. The OR gate 97 has an output terminal connected to one input terminal of an AND gate 100 and also to one input terminal of an AND gate 101 via an inverter 102, the AND gate 100 having the other input terminal supplied with the second indication changeover signal B and the AND gate 101 having the other input terminal supplied with the first indication changeover signal A. The output terminals of the AND gates 100 and 101 are connected through an OR gate 103 in common to one input terminal of an AND gate 104, the other input terminal of which is connected to the output terminal of the first counter stage 112*a* in the time-counting circuit 112. Thus, an output signal from the AND gate 104 is supplied to the time display device 111.

Reference numeral 105 in FIG. 8 denotes an AM/PM changeover indicator, and parts of FIG. 8 corresponding to those of FIG. 1 are denoted by the same reference numerals and description thereof is omitted.

The operation of the time-setting device constructed as shown in FIG. 8 will now be described.

While both first and second switches S11 and S12 for correcting time indication on the display device 111 are kept open, it is assumed that both R–S flip-flop circuits 341 and 94 are maintained in the reset position.

When, under this condition, the second switch S12 is first closed, the AND gate 22 is actuated to supply the AND gate 28 with an output signal from the synchronization control circuit 201. Thus, a K4 signal from the timing pulse generator 14 is stored through the AND gate 26 in the auxiliary counter circuit 301 as in the embodiment of FIG. 1. The resultant K4 signal is supplied from the fourth counter stage 301*d* in the auxiliary counter circuit 301 to the AND gates 311 and 312. At this time, the R–S flip-flop circuit 94 is kept in the reset position.

Thus, time-correcting pulses generated at the rate of one per second by the timing pulse generator 141 is supplied through the AND gate 311 and OR gate 171 to the adder circuit 151 in synchronism with output information from the fourth counter stage 112*d* of the time-consuming circuit 112 which counts time-counting pulses for tracing a lapse of time from 0 to 12 hours in units of hours, whereby the count of the fourth counter stage 301*d* is increased continuously until time indications on the corresponding display elements 111*a* and 111*b* of the time display device 111 coincide with the correct time as in the embodiment of FIG. 1. At the same time, the R–S flip-flop circuit 341 is brought by an output signal from the AND gate 22 to the set position. Thus, thereafter, the positions of the auxiliary counter circuit 301 stored with information are shifted one by one through the AND gates 92 and 211 as in the embodiment of FIG. 1, each time the first normally open switch S11 is closed and opened, whereby time indications on the display element 111*c* for indicating a lapse of time from 0 to 59 minutes in units of 10 minutes, on the display element 111*d* for indicating a lapse of time from 0 to 9 minutes in units of minutes and on the display elements 111*f* to 111*j* jointly for indicating a lapse of time from 0 to 59 seconds in units of 10 seconds are easily corrected through the corresponding counter stages 112*c*, 112*b* and 112*a* of the time-counting circuit 112.

When, on the other hand, time indications on the display elements 111*a* and 111*b* for indicating a lapse of time from 1 to 12 months in units of months, on the display element 111*c* for indicating a lapse of time from 1 to 30 days in units of 10 days, on the display element 111*d* for indicating a lapse of time from 1 to 9 days in units of days and on the display elements 111*e* to 111*j* jointly for indicating a lapse of time from Monday to Saturday in units of 24 hours are to be corrected, then the first normally open switch S11 is first closed and opened together with the second normally open switch S12 so that the AND gate 91 is actuated to produce an output signal for causing the R–S flip-flop circuit 94 to be brought to the set position.

At this time, a K4 signal from the timing pulse generator 141 is stored through the AND gate 28 in the auxiliary counter circuit 301 as in the embodiment of FIG. 1.

Thus, time-correcting signals generated at the rate of one per second by the timing pulse generator 141 are supplied in exact timing with a K8 signal generated thereby to the adder circuit 151 through the AND gate 312 and OR gate 171 in synchronism with an output signal from the eighth counter stage 112*h* of the time-counting circuit 112, whereby the count of the eighth counter stage 112*h* is continuously increased until time indications on the corresponding display elements 111*a* 111*b* coincide with the correct time. Thereafter, the positions of the auxiliary counter circuit 301 stored with information are shifted one by one through the AND gates 92 and 211, each time the first normally open switch S11 is closed and opened, whereby time indications on the remaining display elements 111*c* to 111*j* are easily corrected through the corresponding seventh to fifth counter stages 112*g* to 112*e* of the time-correcting circuit 112.

In this case, the time display device 111 is driven through the OR gate 97, AND gate 100, OR gate 103, AND gate 104 in the condition where any of January to December, any of Sunday to Saturday and any of 1 to 31 days are displayed thereon, since the R–S flip-flop circuit 94 is kept in the set position.

It is noted that the actuation of only the first normally open switch S11 acts to attain the changeover of two kinds of the aforesaid time indications on the time display device 111, since the R–S flip-flop circuit 341 is kept in the reset position, so that no output signal from the AND gate 92 is produced and in consequence the AND gate 98 is actuated to supply an output signal to the OR gate 97.

It will be apparent to those skilled in the art that the present invention is not limited to the time-setting device of the above-mentioned arrangement but applicable to electronic watches or clocks operated by the same technical concept.

What is claimed is:

1. A time-setting device for an electronic watch comprising:

a clock pulse oscillator for generating clock pulses with an accurate frequency;

a time-counting circuit coupled with said clock pulse oscillator and including a plurality of cascade-connected counting stages operative to effect time-counting operations respectively in units of hours, 10-order of minutes, minutes and seconds under control of the clock pulses from said clock pulse oscillator;

time display means coupled with said time-counting circuit and operative to display momentarily changing time signals generated from the counting stages;

an auxiliary counter circuit operative sequentially to designate the counting stages of said time-counting circuit from unit of hour to unit of second;

first and second switch means coupled with said auxiliary counter circuit, said first switch means being first actuated only once, when at least one of the counting stages of said time-counting circuit is required to make a correct count, so as to designate the hightest or hour-counting stage through said auxiliary counter circuit thereby to automatically to start supplying to the designated hour-counting stage time-correction pulses of a predetermined frequency obtained by frequency-dividing the clock pulses, and said second switch means being first actuated, when the hour-counting stage makes a correct count, so as to stop supplying the time-correction pulses of the hour-counting stage and to designate the second or 10-order minute-counting stage of said time-counting circuit through said auxiliary counter circuit thereby automatically to start supplying the time-correction pulses to the designated 10-order minute-counting stage, said second switch means being secondly actuated, when the 10-order miinutes-counting stage makes a correct count, so as to stop supplying the time-correction pulses to the 10-order minutes-counting stage to designate the third or minutes-counting stage of said first time-counting circuit through said auxiliary counter circuit thereby automatically to start supplying the time-correction pulses to the designated minutes-counting stage, said second switch means being actuated further, when the designated minute-counting stage makes a correct count, so as to stop supplying the time-correction pulses to the minutes-counting stage and to designate the lowest or second-counting stage of said first time-counting circuit through said auxiliary counter circuit thereby to clear the designated second-counting stage, and said second switch means being finally actuated while the second-counting stage remains cleared thereby to bring all the counting stages of said time-counting circuit back into the original condition for normal time-counting operation.

2. A time-setting device for an electronic watch comprising:

a clock pulse oscillator for generating clock pulses with an accurate frequency;

a first time-counting circuit coupled with said clock pulse oscillator and including a plurality of cascade-connected counting stages operative to effect time-counting operations for tracing momentarily changing time respectively in units of hour, 10-order of minute, minute and second under control of the clock pulses from said clock pulse oscillator;

a second time-counting circuit coupled with said first time-counting circuit and including at least three cascade-connected counting stages operative to effect time-counting operations for momentarily tracing changing time respectively in units of month, 10-order of days and day under control of output signals from said first time-counting circuit, one for every day;

time display means coupled selectively with said first and second time-counting circuits so as to display selectively signals generated from the respective counting stages of said first and second time-counting circuits;

an auxiliary counter circuit operative sequentially to designate the counting stages from the highest to the lowest stages of the respective time-counting circuits; and first and second switch means coupled with said auxiliary counter circuit, the first switch means being first actuated only once, when at least one of the counting stages of said first time-counting circuit is required to make a correct count, so as to designate the highest or hour-counting stage through said auxiliary counter circuit thereby automatically to start supplying to the designated hour-counting stage time-correction pulses of a predetermined frequency obtained by frequency-dividing the clock pulses, and said second switch means being first actuated, when the hour-counting stage makes a correct count, so as to stop supplying the time-correction pulses to the hour-counting stage and to designate the second or 10-order minute-counting stage of said first time-counting circuit through said auxiliary counter circuit thereby automatically to start supplying the time-correction pulses to the designated 10-order minute-counting stage, said second switch means being secondly actuated, when the 10 order minute-counting stage makes a correct count, so as to stop supplying the time-correction pulses to the 10 order minutes-counter stage and to designate the third or minute-counting stage of said first time-counting circuit through said auxiliary counter circuit thereby automatically to start supplying the time-correction pulses to the designated minutes-counting stage, said second switch means being actuated further, when the designated minute-counting stage makes a correct count, so as to stop supplying the time-correction pulses to the minute-counting stage and to designate the lowest or second-counting stage of said first time-counting circuit through said auxiliary counter circuit thereby to clear the designated second-counting stage, and said second switch means being finally actuated while the second-counting stage remains cleared thereby to bring all the counting stages of said first time-counting circuit back into the original condition for normal time-counting operation; and said first and second switch means being actuated together, when at least one of the counting stages of said second time-counting circuit is required to make a correct count, so as to designate the first or month-counting stage through said auxiliary counter circuit thereby automatically to start supplying the time-correction pulses to the designated month-counting stage, and only said second switch means being secondly actuated, when the designated month-counting stage makes a correct count, so as to stop supplying the time correction pulses to the month-counting stage and to designate the second or 10-order day-counting stage through said auxiliary counter circuit thereby automatically to start supplying the time correction pulses to the designated 10-order day-counting stage, only said second switch means being thirdly actuated, when the 10-order day-counting stages makes a correct count, so as to stop supplying the time-correction pulses to the 10-order day-counting stage and to designate the third or lowest day-counting stage through said auxiliary counter circuit thereby automatically to start supplying the time-correction pulses to the day-counting stage, and only said second switch means being finally actuated, when the designated day-counting stage makes a correct count, so as to stop supplying the time correction pulses to the day-counting stage and to bring all the counting stages of said second time-counting circuit back into the original condition for normal time-counting operation.

3. A time-setting device claimed in claim 2 wherein said time display means is responsive to actuation of only said second switch means during time indication on said time display associated with said first time-counting circuit, to display the signals generated from the respective counting stages of said second time-counting circuit, instead of displaying the signals generated from the respective counter stages of said first time-counting circuit.

4. A time-setting device for an electronic watch comprising:

a clock pulse oscillator for generating clock pulses with an accurate frequency;

a first time-counting circuit coupled with said clock pulse oscillator and including a plurality of cascade-connected counting stages operative to effect time-counting operations for tracing momentarily changing time respectively in units of hour, 10-order of minute, minute and second under control of the clock pulses from said clock pulse oscillator;

a second time-counting circuit coupled with said first time-counting circuit and including at least three cascade-connected counting stages operative to effect time-counting operations for momentarily tracing changing time respectively in units of month, 10-order of days, day and week under control of output signals from said first time-counting circuit, one for every day;

time display means coupled selectively with said first and second time-counting circuits so as to display selectively signals generated from the respective counting stages of said first and second time-counting circuits;

an auxiliary counter circuit operative sequentially to designate the counting stages from the highest to the lowest stages of the respective time-counting circuits; and first and second switch means coupled with said auxiliary counter circuit, the first switch means being first actuated only once, when at least one of the counting stages of said first time-counting circuit is required to make a correct count, so as to designate the highest or hour-counting stage through said auxiliary counter circuit thereby automatically to start supplying to the designated hour-counting stage time-correction pulses of a predetermined frequency obtained by frequency-dividing the clock pulses, and said second switch means being first actuated, when the hour-counting stage makes a correct count, so as to stop supplying the time-correction pulses to the hour-counting stage and to designate the second or 10-order minute-counting stage of said first time-counting circuit through said auxiliary counter circuit thereby automatically to start supplying the time-correction pulses to the designated 10-order minute-counting stage, said second switch means being secondly actuated, when the 10 order minute-counting stage makes a correct count, so as to stop supplying the time-correction pulses to the 10 order minutes-counter stage and to designate the third or minutes-counting stage of said first time-counting circuit through said auxiliary counter circuit thereby automatically to start supplying the time-correction pulses to the designated minutes-counting stage, said second switch means being actuated further, when the designated minute-counting stage makes a correct count, so as to stop supplying the time-correction pulses to the minute-counting stage and to designate the lowest or second-counting stage of said first time-counting circuit through said auxiliary counter circuit thereby to clear the designated second-counting stage, and said second switch means being finally actuated while the second-counting stage remains cleared thereby to bring all the counting stages of said first time-counting circuit back into the original condition for normal time-counting operation; and said first and second switch means being actuated together, when at least one of the counting stages of said second time-counting circuit is required to make a correct count, so as to designate the first or month-counting stage through said auxiliary counter circuit thereby automatically to start supplying the time-correction pulses to the designated month-counting stage, and only said second switch means being secondly actuated, when the designated month-counting stage makes a correct count, so as to stop supplying the time correction pulses to the month-counting stage and to designate the second or 10-order day-counting stage through said auxiliary counter circuit thereby automatically to start supplying the time correction pulses to the designated 10 -order day-counting stage, only said second switch means being thirdly actuated, when the 10-order day-counting stage makes a correct count, so as to stop supplying the time-correction pulses to the 10-order day-counting stage and to designate the third or lowest day-counting stage through said auxiliary counter circuit thereby automatically to start supplying the time-correction pulses to the day-counting stage, only said second switch means being fourthly actuated, when the day counting stage makes a correct count, so as to stop supplying the time-correction pulses to the day-counting circuit and to designate the week-counting stage through said auxiliary counter circuit thereby automatically to start supplying the time-correction pulses to the day-counting circuit and to designate the week-counting stage through said auxiliary counter circuit thereby automatically to start supplying the time-correction pulses to the week-counting stage, and only said second switch means being finally actuated when the designated week-counting stage makes a correct count so as to stop supplying the time-correction pulses to the week-counting stage and to bring all the counting stages of said second time-counting circuit back into the original condition for normal time-counting operation.

5. A time-setting device claimed in claim 4 wherein aid time display means is responsive to actuation of only said second switch means during time indication on said time display associated with said first time-counting circuit, to display the signals generated from the respective counting stages of said second time-counting circuit, instead of displaying the signals generated from the respective counter stages of said first time-counting circuit.

* * * * *